United States Patent [19]

Burn et al.

[11] Patent Number: 4,909,241

[45] Date of Patent: Mar. 20, 1990

[54] ELECTRIC PERIODONTAL MASSAGER

[76] Inventors: Chester A. Burn, 1838 Clermont, Denver, Colo. 80220; James K. Henderson, 961 S. Futton St.; Wilfrid M. Raemer, 908 S. Elmira, both of Denver, Colo. 80231

[21] Appl. No.: 355,489

[22] Filed: May 23, 1989

[51] Int. Cl.[4] ..... A61H 7/00

[52] U.S. Cl. ..... 128/62 A; 433/122; 15/22 R

[58] Field of Search ..... 128/62 A, 66; 433/80, 433/122, 123; 15/22 R

[56] References Cited

U.S. PATENT DOCUMENTS

| | | | |
|---|---|---|---|
| 360,864 | 4/1887 | Edmonds | 433/122 |
| 2,734,139 | 2/1956 | Murphy | 15/22 R |
| 3,967,617 | 7/1976 | Krolik | 128/62 A |
| 4,178,828 | 11/1979 | Lustig et al. | 128/62 A |
| 4,236,889 | 12/1980 | Wright | 128/62 A |
| 4,326,314 | 4/1982 | Moret et al. | 15/22 R |
| 4,347,839 | 9/1982 | Youngclans, Jr. | 128/62 A |
| 4,365,376 | 12/1982 | Oda et al. | 15/22 R |

*Primary Examiner*—John J. Wilson

*Attorney, Agent, or Firm*—Henderson & Sturm

[57] ABSTRACT

An electric periodontal massager having a housing and a first shaft rotatably disposed therein about an axis. An electric motor is provided for rotating the shaft and a crank is disposed on the other end of the shaft. A second shaft having a rubber or resilient massaging tip thereon is provided for periodontal usage. The other end of the second shaft is resiliently attached to the housing. A resilient linkage has one end thereof attached to the crank of the first shaft and the other end thereof disposed around an intermediate portion of the second shaft whereby rotation of the first shaft by the electric motor causes the first end of the second shaft and thereby the resilient massaging tip to move for applying chemicals to and massaging gum tissue.

6 Claims, 2 Drawing Sheets

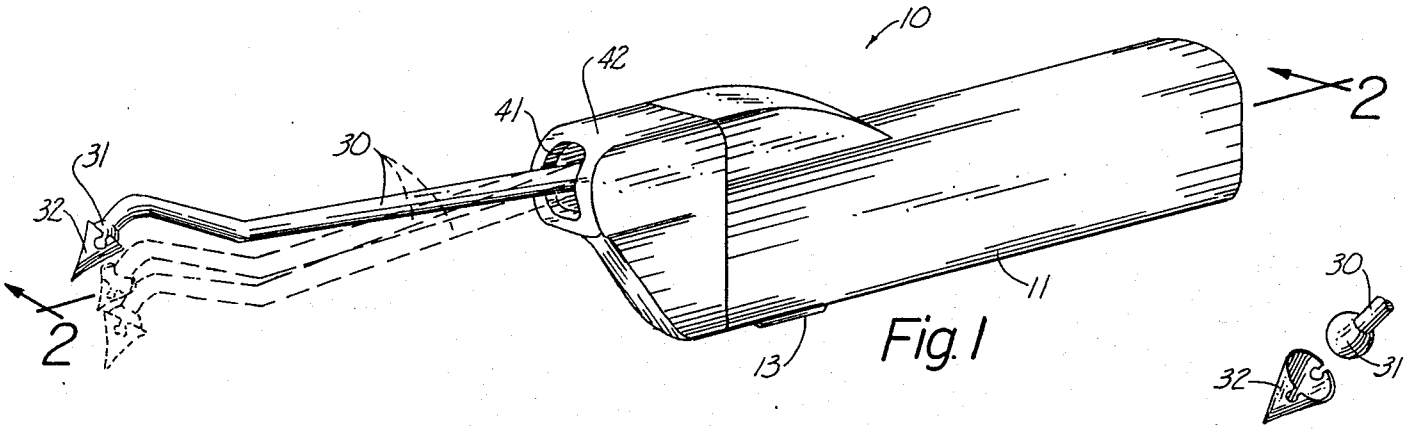
Fig. 1
Fig. 3
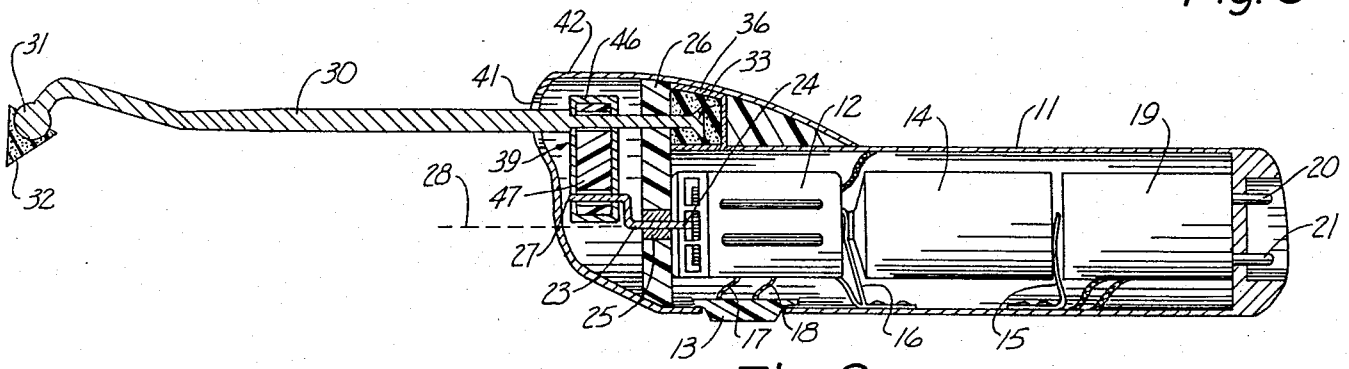
Fig. 2

ELECTRIC PERIODONTAL MASSAGER

TECHNICAL FIELD

The present invention relates generally to a periodontal massager and more particularly to an electric periodontal massager which is powerful enough to do the job but which has shock absorbing features to prevent injury of fragile gum tissue.

BACKGROUND ART

Many people require frequent, if not daily gum massage due to disease or other causes. This requires many hours of hand massaging with a massager having a rubber tip. Also, such a patient will need to apply a chemical mixture to the gums and to pack paste into the subgingival and interproximal areas of the teeth, for the purpose of microbiological control of gingivitis or periodontal disease.

The use of a hand stimulator to achieve the aforementioned result is extremely cumbersome because of problems relating to manual dexterity. Also, the length of time needed to apply the chemical substance, which is typically fifteen to forty minutes a day, is discouraging to the patient. Because of this problem, many patients fail to continue their home care treatment, and those who do continue are not as dedicated, thus having less than optimum results. Consequently, there is a need for a better way to massage and apply a chemical mixture to the gums.

U.S. Pat. No. 4,173,828 to Lustig et al attempts to solve the aforementioned problem, but this device has many moving parts and several disadvantages. It is a direct drive apparatus that is driven with gears and has no shock absorbing features except for resiliency of the rubber tip thereon. If the patient applies too much pressure, it could cause damage to the gum tissue. When something painful such as gum tissue damage occurs, patients often stop the treatment and thereby risk the loss of their teeth at a later date because of the unhealthy gum tissue problem. Accordingly, there is a need for an electric periodontal massager for overcoming the aforementioned problems with the prior art.

DISCLOSURE OF THE INVENTION

The present invention relates to an electric periodontal massager having a housing and a first shaft rotatably disposed therein about an axis. An electric motor is provided for rotting the shaft and a crank is disposed on the other end of the shaft. A second shaft having a rubber or resilient massaging tip thereon is provided for periodontal usage. The other end of the second shaft is resiliently attached to the housing. A resilient linkage has one end thereof attached to the crank of the first shaft and the other end thereof disposed around an intermediate portion of the second shaft whereby rotation of the first shaft by the electric motor causes the first end of the second shaft and thereby the resilient massaging tip to move for applying chemicals to and massaging gum tissue.

An object of the present invention is to provide an electric periodontal massager.

Another object of the present inventions to provide an electric periodontal massager which minimizes the danger of damage to fragile gum issues.

A further object ff the present invention is to provide an electric periodontal massager having shock absorbing resilient structures in the mounting and drive mechanisms thereof.

A still further object of the present invention is to provide an electric periodontal massager of the aforementioned type which can have several massaging tips and shafts that are easily interchangeable.

Other objects, advantages, and novel features of the present invention will become apparent from the following detailed description of the invention when considered in conjunction with the accompanying drawings.

BRIEF DESCRIPTION OF THE DRAWINGS

FIG. 1 is a perspective view of a preferred embodiment of the electric periodontal massager of the present invention showing in solid and dashed lines movement of the massaging tip and the shaft associated therewith;

FIG. 2 is a cross sectional line taken along line 2—2 of FIG. 1 showing the interworkings of the electric periodontal massager of FIG. 1;

FIG. 3 is an exploded perspective view of the rubber tip and how it attaches to the end of the applicator shaft;

BEST MODE FOR CARRYING OUT THE INVENTION

Figure 6:
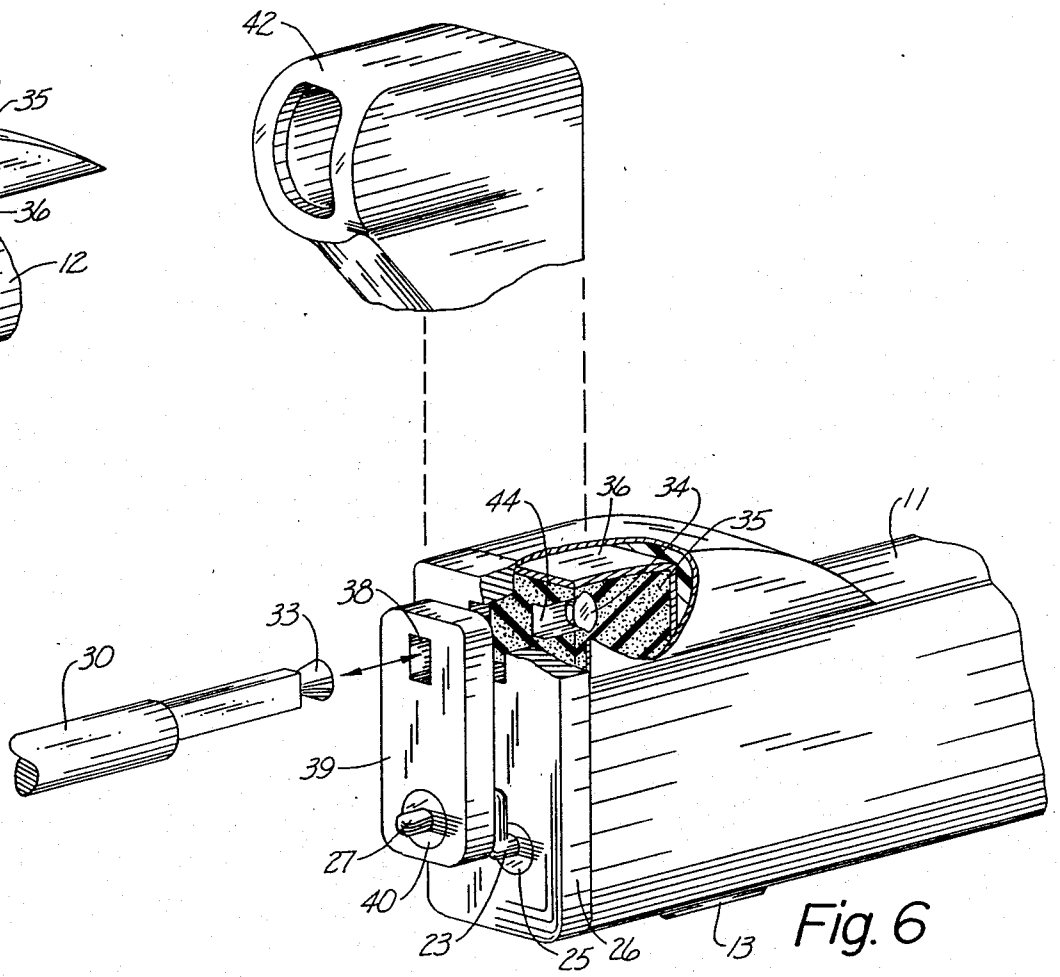
FIG. 6 is an enlarged perspective view of a portion of the present invention illustrating how the applicator shaft is removable and permitting interchangeable applicator shafts.
Figure 4:
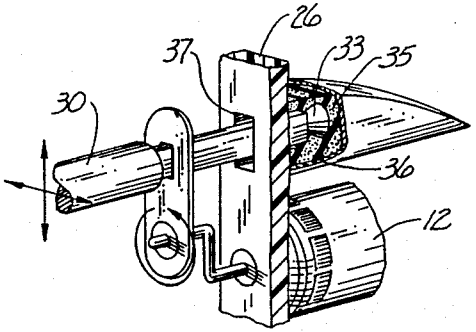
FIG. 4 is a partial perspective view of the driving mechanism of the present invention, also showing the shock absorber type mounting of the applicator shaft.

Referring now to the drawings wherein like reference numerals designate identical or corresponding parts throughout the several views, FIG. 1 shows an electric periodontal massager (10) constructed in accordance with the present invention. A housing (11) is preferably forme of a hard plastic material and has an electric motor (12) disposed therein. This electric motor (12) can be turned on and off by a standard switch mechanism (13), similar to that used in a flashlght. Also, the switch (13) can be used to activate a first and second circuit to vary the speed of the electric motor (12). A battery (14) is disposed within the housing (11) and has a negative wire lead (15) and a positive wire lead (16) which are controlled by the switch (13) for controlling the positive and negative wires (17) and (18) leading the electric motor (12).

A battery recharging device (19) is also disposed within the housing (11) and has contacts (20) and (21) for attachment to normal 110 volt house current. This battery charger (19) will charge the battery (14) when the leads (20) and (21) are connected to standard 110 volt house current.

The motor (12) is operable to rotate a shaft (23) which is attached a one end (24) to the electric motor (12) and extends through a bearing (25) in a supporting wall (26) inside of the housing (11). A crank (27) is displaced from the axis (28) of rotation of the shaft (23) for reasons which will be explained below. An applicator shaft (30) has a spherical tip (31) on one end thereof for receiving a rubber tip (32) thereon, which can be glued by adhesive to the ball (31).

The other end of the applicator shaft (30) has an enlarged frusto-conical end (33) thereon which extends into a frusto-conical opening (34) in a resilient or rubber-like mounting (35) inside of the housing (11). A harder or semi-rigid shell (36) encloses the softer, more resilient and pliable rubber-like material (35). The frusto-conical end (33) isssmall enough to pass through an opening (37) in mounting wall (26) and is also small enough to pass through a rectangular opening (38) in resilient linkage member (39).

The crank portion (27) attached to the shaft (23) is mounted by bearing (40 to the bottom of the resilient linkage (39).

When it is desired to use the electric periodontal massager (10) shown in FIG. 1, a particular appliator tip (30) is chosen and that applicator tip is extended through an opening (41) in cap (42), through opening (38) in linkage member (39) and into the openings (44) and (34) in the soft, liable mounting material (35).

Figure 5:
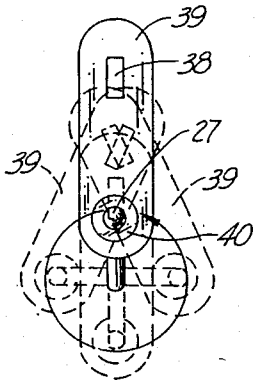
FIG. 5 is a view showing the movement of the resilient linkage member as the crank shaft rotates, thereby causing a resulting movement in the applicator shaft.

The tip (32) is then placed on the portion of the patient's gums desired to be massaged and the switch (13) is turned on to activate the motor (12). This will of course cause the shaft (23) to rotate and the resilient linkage member (39) to move up and down and among and between the positions shown in dashed and solid lines in FIG. 5. The outer potion of the resilient linkae member (39) is constructed of a semi-rigid or harder shell (46) and the inner portion is formed of a softer, more resilient material such as rubber or the like.

This movement of the linkage member (47) will cause a corresponding movement of the shaft (30) and tip (32) as shown n solid and dashed lines in FIG. 1. This movement of the tip (32) will cause the gums to be gently massaged and if there is any tendency for too much pressure to be placed on the gums from the rubber tip (32), this tendency will be dampened to an acceptable level because of the resiliecy of the linkage member (39) and the resilient mounting connection between the enlarged head (33) and the resilient maerial (35).

Accordingly, it will be appreciated that the preferred embodiment described above does indeed accomplish the aforementione objects. Obviously, many modifications and variations of the present invention are possible in light of the above teachings. It is therefore to be understood that, within the scope of the appended claims, the invention may be practiced otherwise than as specifically described.

We claim:

1. A periodontal gum and dental care apparatus comprising:

a housing;

a first shaft being rotatable about an axis;

means for rotatably attaching sid shaft to said housing;

an electric motor means attached to said shaft for selectively rotating said shaft;

crank means disposed on the other end of said shaft, said crakk means being disposed radially outwardly from said axis;

a second shaft having a first end, a second end and an intermediate portion between the first and second ends thereof;

a resilient massaging tip disposed on the first end of said second shaft;

means for resiliently attaching the second end of said second shaft to said housing; and a resilient linkage having one end thereof attached to said crank means and the other end thereof disposed around said intermediate portion of said second shaft whereby rotation of said first shaft by said electric motor means causes the first end of said second shaft and thereby said resilient massaging tip to move for applying chemicals to and massaging gum tissue.

2. The apparatus of claim 1 wherein said electric motor is battery powered and a battery is disposed inside said housing.

3. The apparatus of claim 2 whereby said battery is rechargeable and a means for recharging said battery is disposed in said housing.

4. The apparatus of claim 1 wherein said resilient attaching means comprises a soft, pliable rubber material in said housing and having an enlarged end of said second shaft disposed therein for giving a dampening action to said second shaft as it moves.

5. The apparatus of claim 4 wherein said soft, pliable rubber material has a hard, outer shell in abutment with said housing.

6. The apparatus of claim 1 wherein said resilient linkage has semi-rigid outer shell and an inner pliable resilient material therein for dampening the movement of said second shaft.

* * * * *